US012389960B2

(12) United States Patent
Pope

(10) Patent No.: US 12,389,960 B2
(45) Date of Patent: Aug. 19, 2025

(54) FACE SHIELD

(71) Applicant: Thomas Pope, Cibolo, TX (US)

(72) Inventor: Thomas Pope, Cibolo, TX (US)

( * ) Notice: Subject to any disclaimer, the term of this patent is extended or adjusted under 35 U.S.C. 154(b) by 823 days.

(21) Appl. No.: 17/522,349

(22) Filed: Nov. 9, 2021

(65) Prior Publication Data

US 2022/0175065 A1 Jun. 9, 2022

Related U.S. Application Data

(60) Provisional application No. 63/122,622, filed on Dec. 8, 2020.

(51) Int. Cl.
*A41D 13/11* (2006.01)

(52) U.S. Cl.
CPC ..... *A41D 13/1184* (2013.01)

(58) Field of Classification Search
CPC ..... A41D 13/1184; A41D 2300/33; A41D 13/1161; A41D 27/12; A41D 13/11; A62B 18/08; A42B 3/30; A42B 3/18; A42B 3/185; A42B 3/20; A42B 3/205; A42B 3/22; A61B 90/04
See application file for complete search history.

(56) References Cited

U.S. PATENT DOCUMENTS

2007/0048356 A1* 3/2007 Schorr ..... C08K 5/0058 424/443
2022/0016450 A1* 1/2022 Hall ..... A42B 3/281
2022/0110384 A1* 4/2022 Olivarez ..... A41D 13/1184
2022/0142287 A1* 5/2022 Newton ..... A41D 13/1184
2022/0176168 A1* 6/2022 Adams ..... H04R 1/083
2022/0295923 A1* 9/2022 Hall ..... A62B 18/045

FOREIGN PATENT DOCUMENTS

CN 109391653 A * 2/2019 ..... A41D 13/11

* cited by examiner

*Primary Examiner* — Ophelia A Hawthorne
(74) *Attorney, Agent, or Firm* — Brennan, Manna & Diamond, LLC

(57) ABSTRACT

The present invention relates to an improved face shield that offers a way to keep the wearer safe from harmful airborne pathogens and other pollutants, while still performing a job or task. The face shield has a transparent or translucent frame and a headband for securing the face shield. The face shield is integrated with at least one microphone, an optional speaker, a digital display disposed on the headband, a wireless module and connection ports. A plurality of sensors augments the protection of the wearer and other users and calculate the oxygen level and the temperature of the wearer as well as other sensors. Connection ports such as XLR port can be used for connecting the face shield to speaker, and a USB port can be used for connecting to a handheld electronic device.

18 Claims, 6 Drawing Sheets

FACE SHIELD

CROSS-REFERENCE TO RELATED APPLICATION

The present application claims priority to, and the benefit of, U.S. Provisional Application No. 63/122,622, which was filed on Dec. 8, 2020, and is incorporated herein by reference in its entirety.

FIELD OF THE INVENTION

The present invention relates generally to the field of personal protective equipment. More specifically, the present invention relates to an improved face shield that offers a way to keep the wearer safe from harmful airborne pathogens, pollutants and other contaminants while still performing the job other tasks or engaging in social activities. The face shield has a transparent glass, Plexiglass or polyethylene frame that provides effective protection from pathogens and germs that can cause serious illness and a headband for securing the face shield to the head of the wearer. The face shield is integrated with at least one microphone, an optional speaker, a headband having a display, a wireless module and connection ports in order to ensure the wearer is properly heard by others and is comfortable while wearing the shield. A plurality of sensors augments the protection of the wearer and such as by calculating the oxygen level, humidity and the temperature of the wearer. Other sensors can be used to determine respiratory rates and other related information. Accordingly, this disclosure makes specific reference thereto the present invention. Nonetheless, it is to be appreciated that aspects of the present invention are also equally applicable to other like applications, devices and methods of manufacture.

BACKGROUND

By way of background, various types of germs, viruses, bacteria, other harmful pathogens as well as pollutants, contaminants and particulates are present in the surroundings, which when inhaled by individuals, can be extremely dangerous for their health and may cause serious illness amongst the individuals breathing the contaminated air. Additionally, in the event of a pandemic such as SARS or COVID-19, these infectious diseases can easily transmit from one person to another and can affect a large number of people around the world. During times of unhealthy air quality, people with respiratory ailments, such as asthma, find it difficult to breathe and as such may limit their ability to participate in social activities or even travel outdoors. During such times, people are advised to wear face shields or face masks to prevent the spread of infectious diseases and to avoid difficulty breathing. Without wearing personal equipment like a face shield or a face mask, people may be at risk for contracting deadly diseases or suffer other respiratory distress.

Standard face masks cover the nose and mouth of the individuals in order to form a barrier between the surroundings and the nasal and or oral passage of the wearer. The face mask includes several layers of material that blocks the passage of germs and other contaminants. However, the use of multiple layers of material in face masks to provide enhanced protection against transmission of infectious diseases and other pollutants can block the air that an individual needs to pass through the mask as well, which may cause the wearer to breathe uncomfortably. Also, people while wearing masks are more prone to touching their faces in order to address adjust their mask. Further, the cloth or medical masks may not fit snugly against the face as masks are mass produced, and in a generic manner and faces have different configurations. Also, people who wear masks remain at risk from contamination as their eyes remain exposed.

Standard face shields cover the full face of the individuals in order to form a barrier between the surroundings and the nasal and or oral passages of individual. The face shield includes a transparent frame that provides protection against the splatters, saliva, sneezes and unwanted droplets from others as well as other airborne contaminants.

Additionally, use of conventional face shields at public places such as schools, hospitals, offices, etc. for a long period of time can cause an inconvenience to the wearers. People may be left unheard in case they try to speak while wearing the shield in public places as the shield prevents the sound waves from traveling directly in the intended direction. It can be difficult to hear a person speak if they try to speak while wearing face shield. People may have to either shout or speak loudly in order to be heard by others that are standing nearby. A lot of effort is required in case a person is to give any presentation or have to speak continuously for a long period of time. It is not convenient for a person to continuously speak loudly while talking or instructing others. Also, people may get quickly exhausted in such loud conversations.

Therefore, there exists a long felt need in the art for a face shield and other personal protective equipment that prevents individuals against transmission of harmful pathogens and spread of infectious diseases. There is also a long felt need in the art for an improved face shield which enables the wearer to be easily heard by others while wearing the protective face shield. Additionally, there is a long felt need in the art for an improved face shield that allows the wearer to speak or sing into the microphones to be easily heard while still maintaining protection against harmful airborne pathogens and other pollutants in the surrounding air. Moreover, there is a long felt need in the art for an improved face shield that secures comfortably over the user's ears and fits snugly around the face of the wearer. Further, there is a long felt need in the art for a face shield which enables the individuals to be easily and clearly heard by other individuals and to easily project their instructions and communications to others. Finally, there is a long felt need in the art for an improved face shield that keeps the wearer safe from harmful airborne pathogens and other airborne pollutants while still performing their job or tasks.

The subject matter disclosed and claimed herein, in one embodiment thereof, comprises an improved face shield designed to ensure that the shield wearer is easily heard when speaking while ensuring safety from pathogens, germs and other contaminants. A microphone for capturing sound of the wearer, a speaker for amplifying the sound captured by the microphone and projecting the sound out from the face shield. The face shield also includes a USB connection port, XLR connection port or any other types of ports that are needed to connect to the face shield, such as oxygen tanks. The face shield also includes a wireless system to connect external devices, such as a mobile phone wirelessly with the shield. The face shield also includes a headband and eyeglasses frame that secures the device around the user's ears In this manner, the novel face shield of the present invention accomplishes all of the forgoing objectives, and provides a relatively safe, easy and convenient solution to enable the wearers to project their voice to others while wearing the face shield. The face shield of the present invention is also user-friendly, as it does not require the users to speak loudly or shout in order to be heard by others and eliminates the need to take off the shield while communicating with others. Additionally, the use of the face shield of the present invention ensures a comfortable shield-wearing experience for the users. The face shield allows users to speak or sing into the microphones to be easily heard while still maintaining protection against harmful airborne pathogens and other pollutants. The face shield features audible communications through Wi-Fi, Bluetooth, USB, and XLR connections to enable people to speak and be heard by others.

SUMMARY OF THE INVENTION

The following presents a simplified summary in order to provide a basic understanding of some aspects of the disclosed innovation. This summary is not an extensive overview, and it is not intended to identify key and or critical elements or to delineate the scope thereof. Its sole purpose is to present some general concepts in a simplified form as a prelude to the more detailed description that is presented later.

The subject matter disclosed and claimed herein, in one embodiment thereof, comprises a face shield with integrated microphones, display and speaker. The face shield includes a transparent shield for protecting the face of a wearer, and a headband for securing the face shield around the head of the wearer. The headband has a digital display for displaying an advertisement, greeting or message, an XLR connector for connecting a professional microphone or speaker, a USB port for connecting a handheld electronic device through a USB cable, a wireless module for connecting to the handheld electronic devices through a wireless communication channel and a microphone for capturing voice signals of the wearer. The face shield has a speaker for broadcasting the voice signals captured by the microphone in an amplified manner allowing the wearer to be heard easily.

In yet another embodiment, the XLR connector allows the wearer to sing or speak using the microphone and broadcasting the sound using the connected speaker and the XLR connector is a 3-Pin XLR connector.

In yet another embodiment, a face shield with integrated microphones is disclosed. The face shield is designed to be a personal protective face shield, featuring an integrated microphone and a plurality of connection ports. The face shield further includes a transparent or clear frame for covering the face of a wearer and a headband for securing the face shield around the head of the wearer and the glass frame extends downwards from the headband. The face shield has at least one microphone for capturing the sounds emitted by the wearer, an XLR connector for connecting the face shield to a speaker through a cable for enabling the wearer to sing or speak using the microphone and broadcast sounds from the connected speaker.

In yet another embodiment, a face shield for displaying oxygen level and temperature of the wearer is disclosed. The face shield has a digital display disposed on the headband, an oxygen sensor for detecting oxygen level within the mask of the wearer, a temperature sensor for detecting temperature of the wearer and the digital display is configured to display the detected oxygen level and the temperature. Other sensors may be provided to detect humidity levels, air quality, respiratory rates or to collect other data that may be of use to the individual wearing the face shield.

In yet another embodiment, the temperature is displayed when detected above a threshold level such as a normal body temperature 98.6 degrees Fahrenheit. Indicators may also be triggered such a light indicator to show the temperature level.

In yet another embodiment, a face shield with integrated microphones is disclosed. The face shield is designed to be a personal protective face shield featuring one or more integrated microphones, and a plurality of connection ports to connect the face shield to one or more external devices. The face shield further includes a glass frame for covering the face of a wearer, and a headband for securing the face shield around the head of the individual, and the clear frame extends downwards from the headband. The face shield has at least one microphone for capturing the voice or other sounds emitted by the wearer, a USB connector for connecting the face shield to a handheld electronic device through a USB cable for enabling the wearer to use the microphone to talk to a remote user using the electronic device.

In yet another embodiment, the USB cable can be used for playing music stored in the electronic device using the integrated speaker of the face shield. In yet another embodiment, the connection between the face shield and the electronic device is established using a wireless communication channel. The wireless communication channel is established using a wireless module of the face shield. The wireless features can be activated by an application that has been previously downloaded on a smart phone.

In the present invention, a face shield with on or more integrated microphones and speakers to enable effective communication while maintaining safety from airborne pathogens and other pollutants is also disclosed. The face shield has at least one microphone to pick up sound signals of the wearer of the face shield, and a speaker to amplify the sound signals picked up by the microphone to increase the coverage of the sound signals such that the amplified sound signals go a greater distance than if spoken directly.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
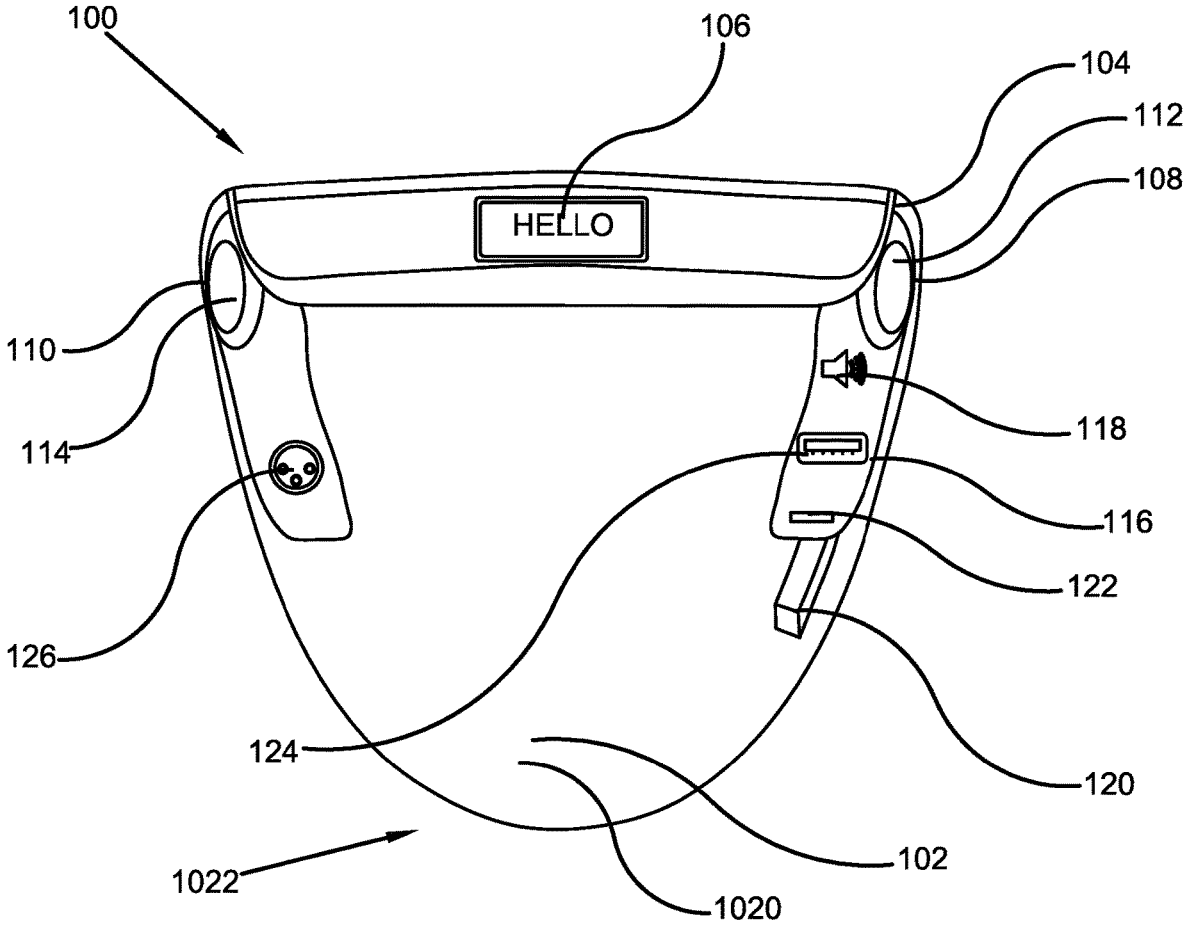
FIG. 1 illustrates a perspective view of one potential embodiment of an improved face shield of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention, and do not limit the scope of the invention. Additionally, an illustrated embodiment need not have all the aspects or advantages shown. Thus, in other embodiments, any of the features described herein from different embodiments may be combined.

As noted above, there exists a long felt need in the art for personal protective equipment that prevents individuals against the transmission of harmful pathogens, and spread of infectious diseases and other harmful pollutants in the surrounding air. There is also a long felt need in the art for an improved face shield which enables the wearer to be heard by others while wearing the protective face shield. Additionally, there is a long felt need in the art for an improved face shield that allows the wearer to speak or sing into the microphones to be easily heard while still maintaining protection against harmful airborne pathogens and other contaminants. Moreover, there is a long felt need in the art for an improved personal protective equipment that secures comfortably on the user's ears, head and face. Further, there is a long felt need in the art for a face shield which enables the individuals to be clearly heard by other individuals and to easily project their instructions and communications to others. Finally, there is a long felt need in the art for an improved face shield or personal protective equipment that helps keep the wearer safe from harmful airborne pathogens and other pollutants while still performing their job or tasks or engaging in other societal activities.

The present invention, in one exemplary embodiment, a novel face shield or protective personal equipment with one or more integrated microphones is disclosed. The face shield is designed to be a personal protective face shield featuring one or more integrated microphones and a plurality of connection ports. The face shield has a transparent frame for covering the face of a wearer, and a headband for securing the face shield around the head of the wearer and the frame extends downwards from the headband. The face shield features at least one microphone for capturing the voice of the wearer, an XLR/USB connector for connecting the face shield to a speaker through a cable for enabling wearer to sing using the microphone and play out sound from the connected speaker.

Referring initially to the drawings, FIG. 1 illustrates a perspective view of the improved face shield or personal protective equipment of the present invention in accordance with the disclosed specification. The face shield 100 of the present invention is designed to ensure that a wearer of the face shield 100 can easily communicate and be easily heard when speaking while wearing the face shield 100. The improved face shield 100 has a shape and size similar to a conventional face covering like a face shield or face mask for providing proper protection against pathogens such as Covid-19, SARS, germs, viruses, other microbes and pollutants. The face shield 100 has a transparent frame 102 to provide full face protection against pathogens such as Covid-19, SARS, germs, viruses, other microbes and pollutants. The transparent eye glass frame 102 also provides protection against splatters, saliva, sneezes and unwanted droplets from others. The frame 102 has an internal surface 1020 and an exterior surface 1022. The exterior surface 1022 can have an anti-static coating treatment that provides the double-sided, anti-fog effect and polarizing film and can have virtually zero reflection from either the external side or the internal viewing side of the face shield 100 in all lighting conditions as well as a color changing effect, e.g., light to dark and dark to light, to reduce glare in different lighting conditions.

The face shield 100 can be made of high quality materials such as super transparent recyclable PET, PET-G, acetate, Plexiglass, polyethylene or polycarbonate sheets, or any other such type of material. The face shield 100 has a headband 104 that is designed to secure the face shield 100 on the wearer's head and around the ears. The headband 104 is preferably an elastic band that has a high-quality foam sponge in the inner surface for comfortable and secure fit around the head of the wearer. The headband 104 foam material in the inner surface ensures that the shield 100 rests comfortably on the forehead such that glass shield 102 extends from the headband 104 down to the chin of the wearer. The headband 104 has a digital display 106 on the outer surface such that the display 106 is positioned on the forehead of the wearer when the face shield or personal protective equipment 100 is donned by the wearer. The digital display 106 displays the real time body temperature of the wearer when the body temperature exceeds the normal body temperature i.e., 98.6° F. The digital display 106 also can also be used for displaying a logo of a company for marketing, communication or advertisement purposes. The digital display 106 can also be used for displaying the real-time oxygen level, temperature and other conditions of the wearer of the face shield 100.

The face shield 100 has a left ear pad 108 and a right ear pad 110, to engage with the respective ears of the wearer wearing the face shield or personal protective equipment 100. The left ear pad 108 and the right ear pad 110 are adjustable and can suit any individual's ear size and position in order to provide a comfortable fit. The ear pads 108, 110 can have built-in speakers 112, 114, respectively, thereby allowing the wearer to hear any sound for facilitating an effective communication between the user and those around the individual.

More specifically, the face shield or personal protective equipment 100 has an electronic bar 116 that has electronic components and circuitry. The bar 116 has a speaker 118 to emit the sound made by the user wearing the face shield 100. At least one microphone 120 is coupled to the speaker 118 pick up the sound emitted by wearer of the personal protective equipment or face shield 100, and the speaker 118 projects the sound picked up by the microphone 120 to project the amplified sound to another person or other people nearby for an effective communication. The power level of the sound captured by the microphone 120 is amplified by the speaker 118 using the built-in amplifier (not shown). The microphone 120 is positioned near the mouth of the wearer when the face shield 100 is worn, so that sound signals are easily captured by the microphone 120. The microphone 120 offers high-quality sound and noise cancellation so that the sound produced by the speaker 118 is clear and loud. The electronic bar 116 features a toggle switch button 122 to turn ON/OFF the speaker 118. The speaker 118 provides an amplified sound such that sound played out of the speaker reaches easily to the person or other people nearby, with whom the user wearing the face shield 100 is speaking or communicating.

The face shield 100 has USB connector port 124 that enables the wearer to connect electronic devices such as a smartphone or other devices using USB cables. The wearer can also connect the face shield 100 to the external mobile phone wirelessly using Wi-Fi, Bluetooth, or any other type of wireless communication technique. The face shield 100 also has an XLR connector 126 for enabling the face shield 100 to connect to professional audio or video equipment. The XLR connector 126 allows a wearer to use professional equipment by connecting to the face shield 100 while wearing the face shield 100. The XLR connector 126 is a three-pin connector and can be used for any balance audio signals. Using the XLR connector 126, the microphone 120 can be used as a professional microphone or the face shield 100 can be connected to a professional microphone or a speaker. It should be noted the embodiments of the personal protective equipment or face shield 100 of the present invention can have four-pin, five-pin, six-pin or seven-pin XLR connectors. Using the XLR connector 126, the wearer can sing using the microphone 120 and the voice can be played out by external speakers connected to the face shield 100 through the XLR connector 126.

It should be noted that both the speaker 118 and the microphone 120 can be manually operated using the toggle button 122 or can be automatically operated by built-in sound sensors disposed within the electronic bar 116 (not shown) that automatically powers up the speaker 118 and the microphone 120.

Figure 2:
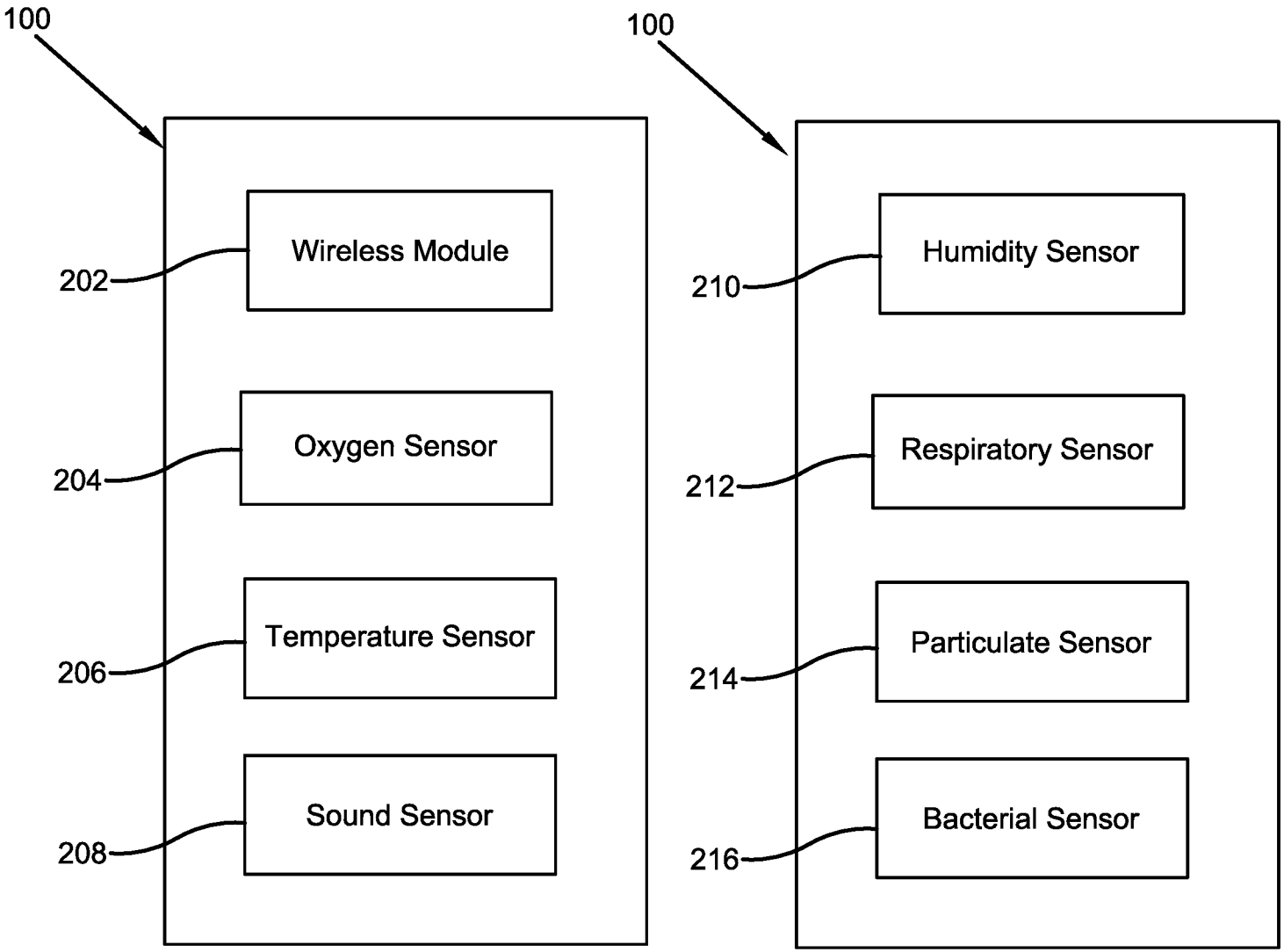
FIG. 2 illustrates a block diagram of exemplary sensors and wireless module components housed within one potential embodiment of the improved face shield of the present invention in accordance with the disclosed architecture.

FIG. 2 illustrates a block diagram showing exemplary sensors and wireless module components housed within the face shield 100 of the present invention in accordance with the disclosed specification. The wireless module 202 is in the form of a small chip, for establishing a wireless communication channel allowing the shield 100 to connect to a handheld electronic device, such as a smartphone. Using the wireless module 202, the speaker 118 can connect to any electronic device or consumer device through the wireless channel. In one embodiment, the speaker 118 can have the built-in wireless module. Preferably, the wireless communication channel is a low energy Bluetooth communication channel.

The shield 100 also has an oxygen sensor 204 that monitors the oxygen level of the wearer of the shield 100. More precisely, the oxygen sensor 204 is disposed in the headband such that the oxygen sensor 204 measures the oxygen concentration in the blood of the wearer with a minimum deviation of +/−1%.

The integrated temperature sensor 206 detects the real-time body temperature of the wearer of the shield 100 and more specifically, detects the temperature of the forehead of the wearer. The temperature sensor 206 measures the temperature of the wearer with an accuracy of ±2° C. The temperature, when detected above a threshold such as normal body temperature, is displayed on the digital display of the face shield. For automatically activating the microphone and/or the speaker, a plurality of sound sensors 208 are disposed along the periphery of the shield of the face shield. The sound sensors 208 detect the sound of the wearer and automatically activates the microphone and/or the speaker. It should be appreciated that the all the sensors are connected through a wired circuit disposed within the electronic bar 116 and the headband 104 of the face shield 100. In an embodiment, the oxygen sensor 204 and the temperature sensor 206 are coupled to the display for displaying the oxygen saturation level and the temperature value of the wearer. The shield 100 may also include a humidity sensor 210 to determine the level of humidity within the mask area so that the wearer can remain comfortable. A respiratory sensor 212 to monitor respiratory rates; a particulate sensor 214 and a bacteria sensor to detect bacteria or other contagions or contaminants.

Figure 3:
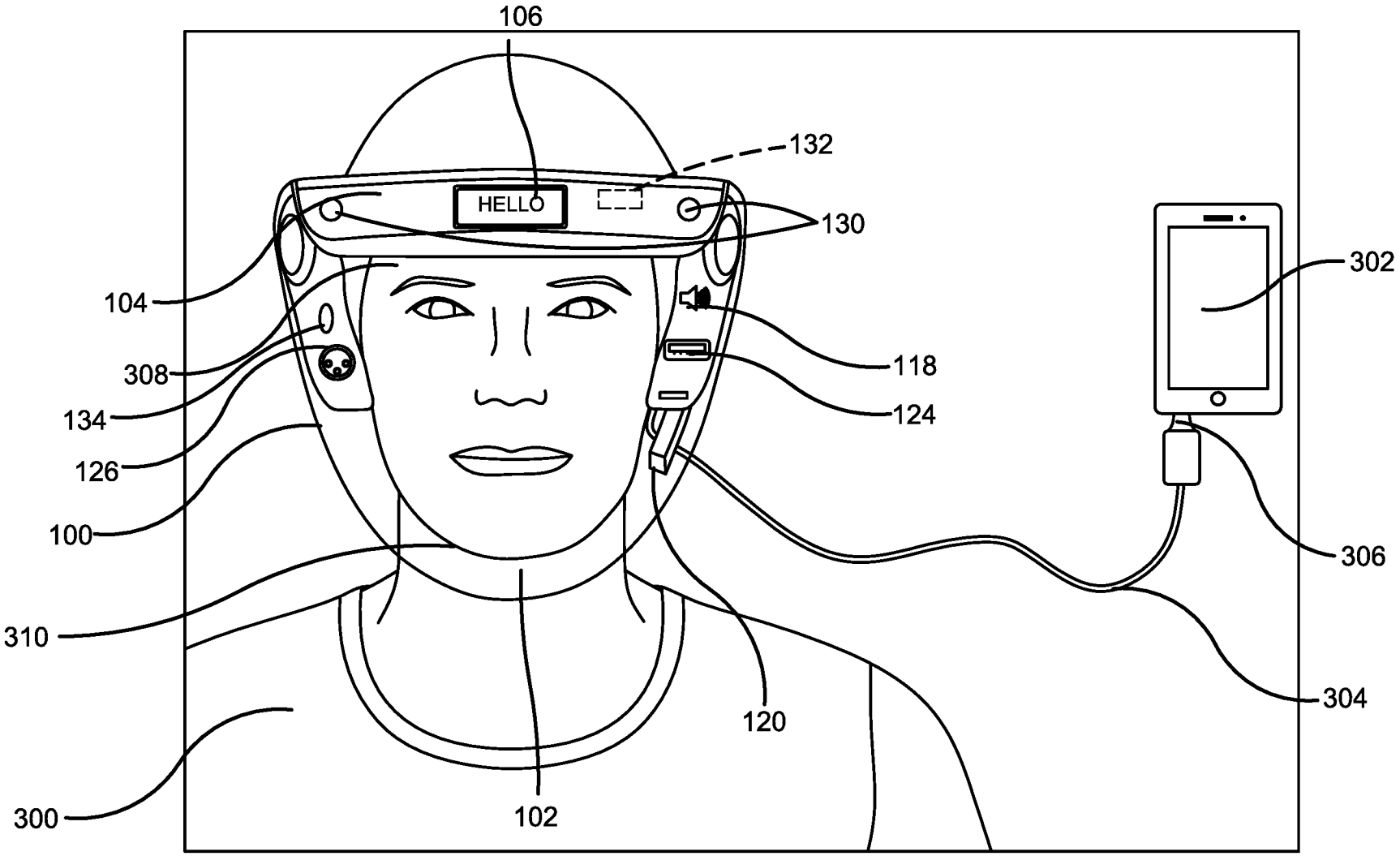
FIG. 3 illustrates a perspective view of a wired-connection between one potential embodiment of the improved face shield of the present invention and an electronic device to use the built-in microphone of the face shield for inputting sound to the electronic device in accordance with the disclosed architecture.

FIG. 3 illustrates a perspective view showing a wired connection between the improved face shield 100 of the present invention and an electronic device to use the built-in microphone of the face shield 100 for inputting sound to the electronic device in accordance with the disclosed specification. As stated earlier, that the integrated face shield or personal protection equipment 100 has a USB connector port 124 that enables the wearer 300 to establish a wired connection between the face shield 100 and an electronic device such as mobile device 302. The mobile device 302 includes a USB connector port 306 that enables the wearer 300 to connect face shield 100 to the electronic device 302 using a USB cable 304. Once the face shield 100 is connected to the mobile device 302, then the voice signals of the user 300 captured by the microphone 120 are transferred to the mobile device 302 over the wired connection using the USB cable 304. Also, voice from the mobile device 302 can be played out from the speaker 118, wherein the voice signals are received from the mobile device 302 over a wired connection using the USB cable 304. The wired connection using USB cable 304 can also enables the user to access phone calls and listen to the music from the mobile device 302. The similar communication can take over any other communication port such as an XLR port.

One of main functions of the face shield 100 is to protect the wearer 300 from pathogens and other contaminants. As shown, the frame 102 covers and protects the face of the wearer 300 from the forehead 308 to the chin 310. The headband 104 having the display 106 is positioned over the forehead 308. The frame 102 conforms to the shape of the face of the wearer 300 and is transparent and or translucent. In one embodiment, a partial portion of the frame 102 can be translucent or have combinations of transparent or translucent as shown in FIG. 5.

Figure 4:
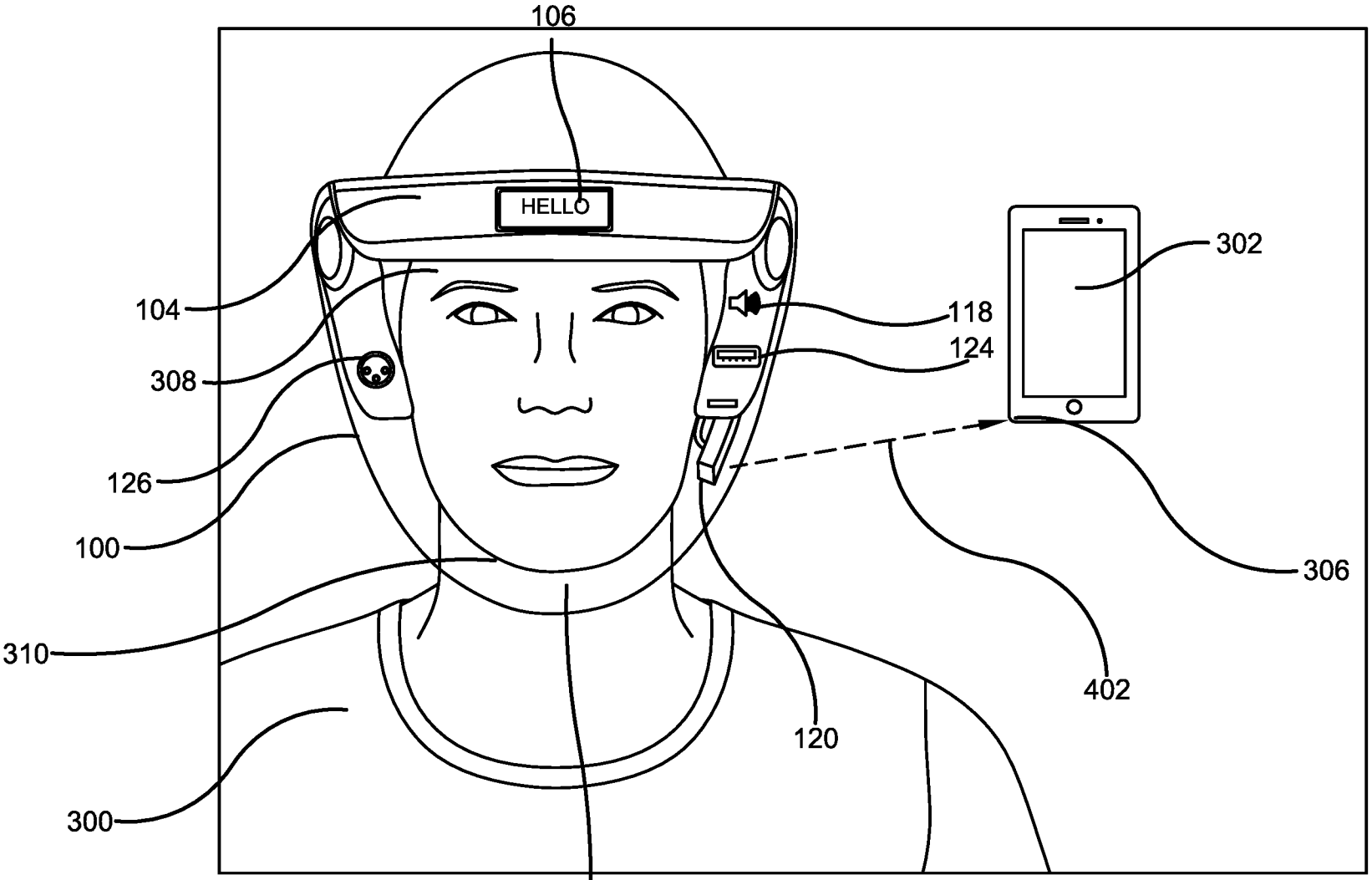
FIG. 4 illustrates a perspective view of a wireless connection between one potential embodiment of the improved face shield of the present invention and the electronic device in accordance with the disclosed architecture.

FIG. 4 illustrates a perspective view showing a wireless connection 402 between the face shield 100 of the present invention and the electronic device 302 in accordance with the disclosed specification. As stated earlier and shown in FIG. 2, the integrated face shield 100 has a wireless module that enables a wireless connection 402 between the face shield 100 and the electronic device 302. The microphone 120 is connected to the electronic device 302 after pairing through the wireless communication technology such as Bluetooth/Wi-Fi Direct/Infrared etc., and the sound signals captured by the microphone 120 are transferred to the smartphone 302 through the communication channel 402. The microphone 120 can be connected to the smartphone 302 to talk on a call in a manner similar to a wireless microphone and speaker. Also, voice from the mobile device 302 can be played out on the speaker 118, such that the voice signals are received from the mobile device 302 over the wireless channel 402. The wireless channel 402 can also enable the user to access phone calls and listen to the music from the mobile device 302.

Figure 5:
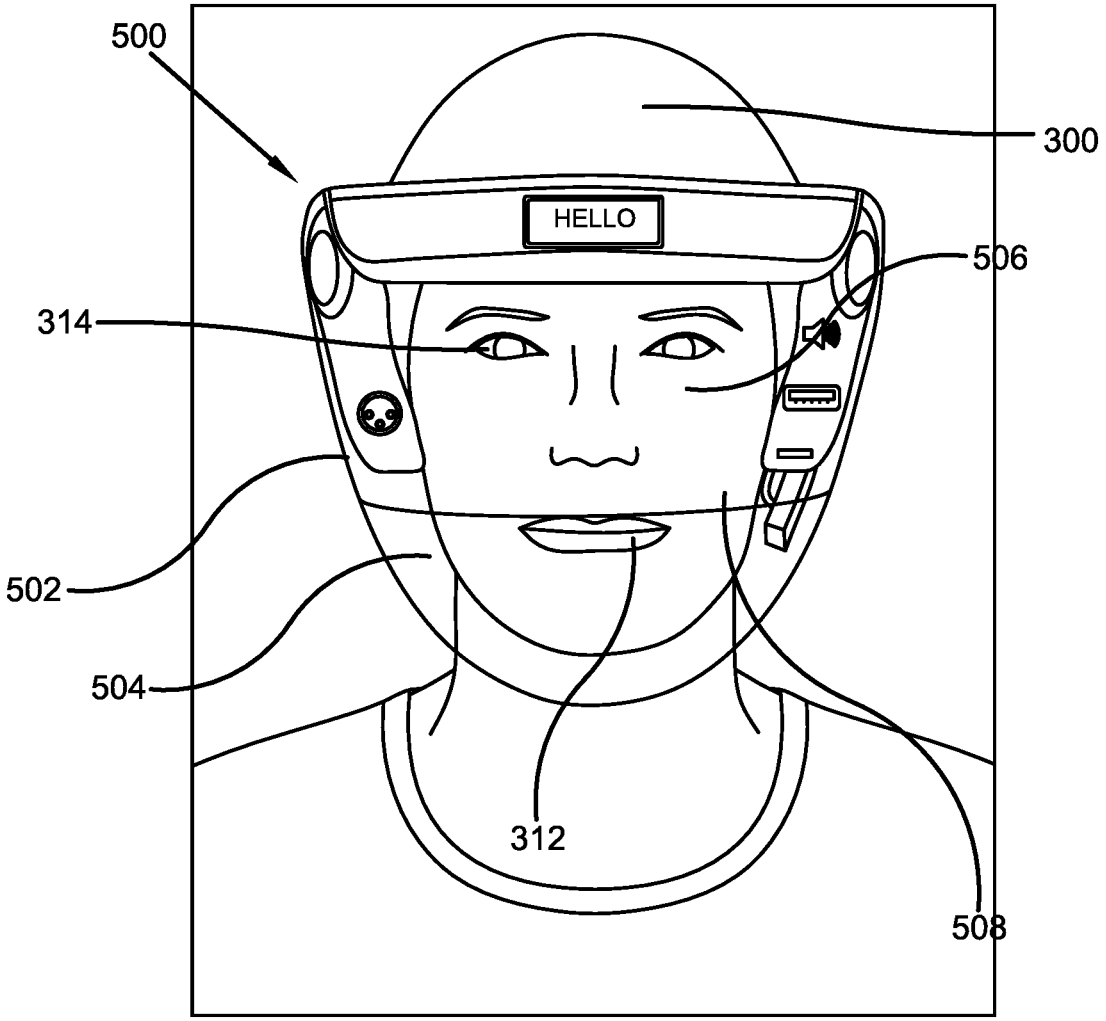
FIG. 5 illustrates an alternative embodiment of the personal protective equipment of the present invention in accordance with the disclosed architecture.

FIG. 5 illustrates an alternative embodiment of the face shield 500 of the present invention in accordance with the disclosed specification. In the present embodiment, the portion 504 of the frame 502 of the personal protective equipment or face shield 500 is translucent or partially transparent or a combination of each, and can cover the mouth 312 of the wearer 300. Further, the upper portion 506 of the glass frame 502 is transparent or translucent allowing the wearer's eyes 314 to view the surroundings clearly and without any obstruction. The lower portion 504 and the upper portion 506 are logically defined by the separator line 508. All other components such as sensors, connectors and display in the present embodiment are similar to the other embodiments of the present invention.

Figure 6:
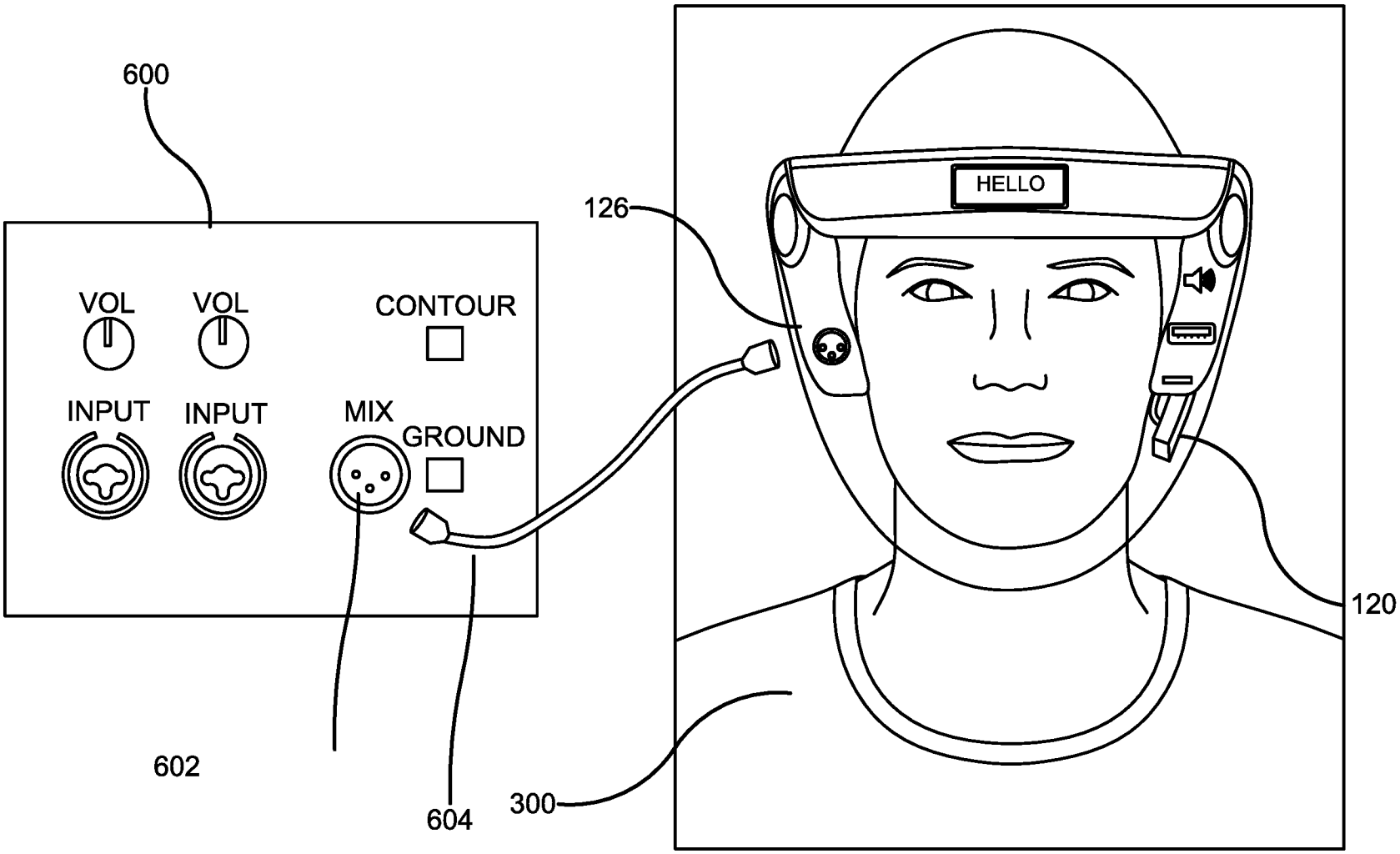
FIG. 6 illustrates a perspective view of a wired connection between one potential embodiment of the personal protective equipment of the present invention and an XLR input speaker using a cable in accordance with the disclosed architecture.

FIG. 6 illustrates a perspective view showing a wired connection between the face shield 100 of the present invention with an XLR input speaker 600 using a cable 604 in accordance with the disclosed specification. The XLR connector 126 is used for connecting the face shield 100 to a professional speaker 600 using the cable 604 by coupling the connector 602 disposed on the speaker 600 and the opposing connector disposed on the face shield 100. When a successful connection is made, one or more microphones 120 can be used by the wearer 300 for singing a song or giving a presentation that can be played out by the speaker 600.

In a further embodiment of the present invention, the face shield may comprise small reading lights 130 on the corners of the face shield that may be powered by a battery 132 and controlled by a multi-functional control 134. The reading lights 130 may be of different colors and modes of operation such as, but not limited to, continuous, intermittent, blinking, etc.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "improved face shield", "integrated face shield", "face shield", "shield", "protective face shield", and "wireless face shield" are interchangeable and refer to the face shield 100, 500 with integrated speaker and microphone of the present invention.

Notwithstanding the forgoing, the face shield 100, 500 with integrated speaker and microphone of the present invention can be of any suitable size and configuration as is known in the art without affecting the overall concept of the invention, provided that it accomplishes the above-stated objectives. One of ordinary skill in the art will appreciate that the size, configuration and material of the face shield 100, 500 with integrated speaker and microphone as shown in the FIGS. are for illustrative purposes only, and that many other sizes and shapes of the face shield 100, 500 with integrated speaker and microphone are well within the scope of the present disclosure. Although the dimensions of the face shield 100, 500 with integrated speaker and microphone are important design parameters for user convenience, the face shield 100, 500 with integrated speaker and microphone may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A personal protection equipment comprising:

a shield covering a substantial portion of a face of a wearer and manufactured from a substantially rigid material that is either transparent or translucent and comprises an anti-static exterior surface;

a foam sponge inner surface elastic headband to support the shield on a head of the wearer, wherein the headband comprises an adjustable configuration and a pair of deformable adjustable ear pads;

at least one microphone for projecting a sound from the wearer;

a plurality of reading lights disposed on the shield;

a USB connector port for connecting the personal protective equipment to a mobile electronic device; and a plurality of sound sensors disposed along a periphery of the shield configured to detect a sound from the wearer and automatically activate the microphone.

2. The personal protection equipment as recited in claim 1, wherein the shield further comprises a speaker connected to the at least one microphone.

3. The personal protection equipment as recited in claim 2, wherein the speaker is connected to the at least one microphone by one of a wireless connection or a cord.

4. The personal protection equipment as recited in claim 2, wherein the speaker is connected wirelessly to a smart phone having an application downloaded to the smart phone.

5. The personal protection equipment as recited in claim 1, wherein the shield comprises a plurality of sensors.

6. The personal protection equipment as recited in claim 5, wherein the plurality of sensors further comprise a sensor for detecting at least one of a respiratory, a humidity, a particulate or a bacterial level.

7. The personal protection equipment as recited in claim 5, wherein the plurality of sensors comprise a respiratory level sensor, a humidity sensor, a particulate level sensor and a bacterial level sensor.

8. The personal protection equipment as recited in claim 1 further comprising a polarizing coating to change from a light to a dark or the dark to the light.

9. The personal protection equipment as recited in claim 1, wherein the shield further comprises an anti-fogging coating to reduce a glare and fogging of the shield.

10. A personal protection equipment system comprising:

a face shield having a microphone and a speaker, wherein the microphone is in communication with the speaker;

a smart phone having an application downloaded to receive a signal from the speaker or the microphone;

a foam sponge inner surface elastic headband for supporting the face shield on a head of a wearer and comprised of a pair of deformably adjustable ear pads;

a visual display on the face shield;

a plurality of reading lights disposed on the shield;

a XLR three pin connector for connecting the personal protective equipment to an external speaker; and a plurality of sound sensors disposed along a periphery of the face shield configured to detect a sound from the wearer and automatically activate the microphone and the speaker.

11. The personal protection equipment system as recited in claim 10, wherein the face shield is comprised of a transparent or translucent material.

12. The personal protection equipment system as recited in claim 11, wherein the face shield further comprises at least one of a polarizing coating or an anti-fogging coating.

13. The personal protection equipment system as recited in claim 12, wherein the polarizing coating changes the face shield from a light to a dark or the dark to the light.

14. The personal protection equipment system as recited in claim 10, wherein the face shield comprises a plurality of sensors.

15. The personal protection equipment system as recited in claim 14, wherein the plurality of sensors comprise a sensor for detecting at least one of a respiratory level, a humidity, a particulate level and a bacterial level.

16. The personal protection equipment system as recited in claim 10, wherein the visual display is configured to illustrate a message, a communication or an advertisement.

17. The personal protection equipment system as recited in claim 10, wherein the face shield is comprised of at least one of a glass, a plexiglass, a polycarbonate, a polyethylene, a recyclable PET, a PET-G and an acetate.

18. A face shield device comprising:

a face shield comprised of at least one of a glass, a plexiglass, a polycarbonate, a polyethylene, a recyclable PET, a PET-G and an acetate;

a foam sponge inner surface elastic head band for supporting the face shield on a head of an individual, wherein the headband comprises a pair of deformably adjustable ear pads and is expandable and retractable in size;

at least one microphone for collecting a sound from the individual;

at least one speaker in communication with the at least one microphone and controlled by a toggle switch;

a smart phone wirelessly connected to at least one of the at least one speaker and the at least one microphone;

a display positioned on the headband; and a plurality of sensors disposed on the face shield, wherein the plurality of sensors comprises an oxygen sensor, a temperature sensor and a sound sensor;

a plurality of reading lights disposed on the shield;

a multifunctional control configured to adjust a mode of operation of the plurality of reading lights;

a USB connector port for connecting the personal protective equipment to a mobile electronic device; and a plurality of sound sensors disposed along a periphery of the face shield configured to detect a sound from the wearer and automatically activate the at least one microphone and the at least one speaker.

* * * * *